US006171217B1

(12) United States Patent
Cutler

(10) Patent No.: US 6,171,217 B1
(45) Date of Patent: Jan. 9, 2001

(54) CONVERTIBLE ELLIPTICAL AND RECUMBENT CYCLE

(76) Inventor: Gordon L. Cutler, 549 E. Aspen Ridge La., Providence, UT (US) 84332

( * ) Notice: Under 35 U.S.C. 154(b), the term of this patent shall be extended for 0 days.

(21) Appl. No.: 09/247,159

(22) Filed: Feb. 9, 1999

(51) Int. Cl.[7] ..... A63B 22/00
(52) U.S. Cl. ..... 482/57; 482/52; 482/70
(58) Field of Search ..... 482/51–53, 57, 482/70, 79, 80

(56) References Cited

U.S. PATENT DOCUMENTS

| | | | |
|---|---|---|---|
| 3,316,898 | 5/1967 | Brown . | |
| 5,242,343 | 9/1993 | Miller | 482/57 |
| 5,383,829 | 1/1995 | Miller | 482/57 |
| 5,518,473 | 5/1996 | Miller | 482/57 |
| 5,527,246 | 6/1996 | Rodgers, Jr. | 482/57 |
| 5,529,555 | 6/1996 | Rodgers, Jr. | 482/57 |
| 5,540,637 | 7/1996 | Rodgers, Jr | 482/52 |
| 5,549,526 | 8/1996 | Rodgers, Jr. | 482/57 |
| 5,562,574 | 10/1996 | Miller | 482/51 |
| 5,573,480 | 11/1996 | Rodgers, Jr. | 482/57 |
| 5,577,985 | 11/1996 | Miller | 482/52 |
| 5,591,107 | 1/1997 | Rodgers, Jr. | 482/57 |
| 5,593,371 | 1/1997 | Rodgers, Jr. | 482/51 |
| 5,593,372 | 1/1997 | Rodgers, Jr. | 482/52 |
| 5,595,553 | 1/1997 | Rodgers, Jr. | 482/51 |
| 5,611,756 | 3/1997 | Miller | 482/52 |
| 5,611,757 | 3/1997 | Rodgers, Jr. | 482/57 |
| 5,611,758 | 3/1997 | Rodgers, Jr. | 482/57 |
| 5,637,058 | 6/1997 | Rodgers, Jr. | 482/51 |
| 5,653,662 | 8/1997 | Rodgers, Jr. | 482/52 |
| 5,683,333 | 11/1997 | Rodgers, Jr. | 482/57 |
| 5,685,804 | 11/1997 | Whan-Tong et al. | 482/51 |
| 5,690,589 | 11/1997 | Rodgers, Jr. | 482/57 |
| 5,738,614 | 4/1998 | Rodgers, Jr. | 482/51 |
| 5,743,834 | 4/1998 | Rodgers, Jr. | 482/57 |
| 5,788,610 | 8/1998 | Eschenbach | 482/52 |
| 5,916,065 * | 6/1999 | McBride et al. | 482/57 |
| 5,928,114 * | 7/1999 | Chen | 482/57 |
| 6,071,215 * | 6/2000 | Raffo et al. | 482/57 |

FOREIGN PATENT DOCUMENTS 29 19 494 A1 11/1980 (DE) .

* cited by examiner

*Primary Examiner*—Stephen R. Crow
(74) *Attorney, Agent, or Firm*—Workman, Nydegger & Seeley

(57) ABSTRACT

An exercise apparatus includes a base having a brace upstanding therefrom. A support member including a rail having a seat mounted thereon is rotatably connected to the brace. Mounted to the front end of the base are a pair tracks. Positioned on opposing sides of the support stand are a pair of linear foot rails. The front end of each foot rail has a wheel rotatably mounted thereon and disposed on a corresponding track. The second end of each foot rail is rotatably mounted to the base by a crank assembly. Positioned at the front end of each foot rail is a first foot pad. Positioned at the second end of each foot rail is a second foot pad. By either standing on the first foot pads or sitting on the seat and pushing against the second foot pads, each of the foot rails can be moved in an elliptical path for exercising the leg muscles of a user.

24 Claims, 7 Drawing Sheets

CONVERTIBLE ELLIPTICAL AND RECUMBENT CYCLE

BACKGROUND OF THE INVENTION

1. The Field of the Invention

The present invention relates to exercise equipment and, more specifically, convertible exercise apparatus that produce elliptical foot displacement.

2. The Relevant Technology

A variety of indoor exercising equipment has been develop to exercise leg muscles commonly used in running, skiing, and other outdoor activities. Such machines include treadmills, stepping machines, and various types of sliding machines. Although effective to some extent, each of these machines has select disadvantages. For example, most treadmills wear quickly under the jarring of heavy jogging or running. Furthermore, treadmills have the drawback of producing high impact on the user's legs and knees. One approach that minimizes jarring is to use a stair stepper. Stair steppers, however, do not develop all of the muscles commonly used in running. Furthermore, such machines are difficult to use in sprint type exercises. Finally, sliding machines require the user to slide their feet back and forth along a horizontal plane. Such movement does not mimic running and thus exercises only a limited range of muscles.

Recent designs in exercise equipment have attempted to resolve some of the above problems by having a pair of spaced apart foot rails wherein each front end rotates in an elliptical path while each rear end moves along a horizontal plane. The center of each foot rail, on which the user's feet are positioned, also rotates in an elliptical path. This elliptical path is substantially similar to that commonly encountered during running. Likewise, since the user's feet never leave the foot rails, minimal impact is produced.

Several problems, however, have been encountered with such designs. For example, such apparatus commonly include a complexity of interrelated moving parts. This complexity increases the cost and time of manufacturing. An additional problem with such machines is that it is often difficult or impossible to adjust the path or movement of the foot pad to correspond with the stride of the user.

An additional problem with conventional elliptical displacement apparatus is that they are designed only for operation in one set standing position. As a result, the apparatus is limited to exercising one set group of muscles. If other muscles are to be exercised, a different apparats must be purchased.

OBJECTS AND BRIEF SUMMARY OF THE INVENTION

Accordingly, it is an object of the present invention to provide improved exercise apparatus that produce elliptical foot movement similar to that of running.

Another object of the present invention is to provide the above exercise apparatus that have a simpler mechanical design than corresponding prior art designs.

Yet another object of the present invention is to provide the above exercise apparatus which can be easily adjusted for users having different strides.

Finally, it is another object of the present invention to provide the above exercise apparatus which can be selectively converted for operation in different modes so as to exercise different muscles.

To achieve the foregoing objectives, and in accordance with the invention as embodied and broadly described herein, an exercise apparatus is provided. The exercise apparatus includes a frame comprising an elongated base having a brace upstanding therefrom. Mounted to the brace is a back rest and a support member. The support member includes a rail having a first end rotatably mounted to the brace and an opposing second end having a seat positioned thereat.

Positioned on each side of the base is a moveable foot rail. The front end of each foot rail has a wheel which is disposed in a linear track. The second end of each foot rail is rotatably attached to a crank assembly. The crank assembly is mounted on the base and includes crank arms that project in opposing directions. The end of each crank arm is connected to a corresponding foot rail such that linear displacement of the front end of the foot rail results in circular displacement of the second end of the foot rail.

Positioned towards the front end of each foot rail is a first foot pad. Positioned towards the second end of each foot rail is a second foot pad. Each foot pad is mounted by a bracket which permit the foot pad to be selectively moved along the length of each foot rail.

By either standing on the first foot pads or sitting on the seat and pushing against the second foot pads, each of the foot rails can be moved in an elliptical path for exercising the leg muscles of a user.

The exercise apparatus can be selectively adjusted for operation by the user in either a standing or sitting position. The different positions exercise different sets of muscles. To exercise in the standing position, the support member is moved into a raised first position and the user stands on the first foot pads. If desired, the user can rest his or her arms on the rail. In this position, the user uses his or her leg muscles to move the foot rails in inverse reciprocating movement. As a result of the first end the foot rails moving in linear reciprocating movement and second end of the foot rails moving in circular movement, the first foot pads disposed between the opposing ends move in a substantially elliptical path.

To exercise in the sitting position, the support member is lowered into a second position. The user then sits on the seat with his or her back against the back rest and feet against the second foot pads. By pushing against the second foot pads, the second foot pads are also moved in a substantially elliptical path.

The inventive exercise apparatus has a variety of unique benefits over conventional stepping type apparatus. For example, as a result of producing an elliptical displacement of the foot pads, the exercise is preformed using a more natural stride with minimal jarring or impact. Furthermore, the ability to use the exercise apparatus in both a sitting and standing position allows the user to exercise different groups of muscles in different way. Finally, easy movement of the foot pads enables different users to set the apparatus to their individual stride length.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
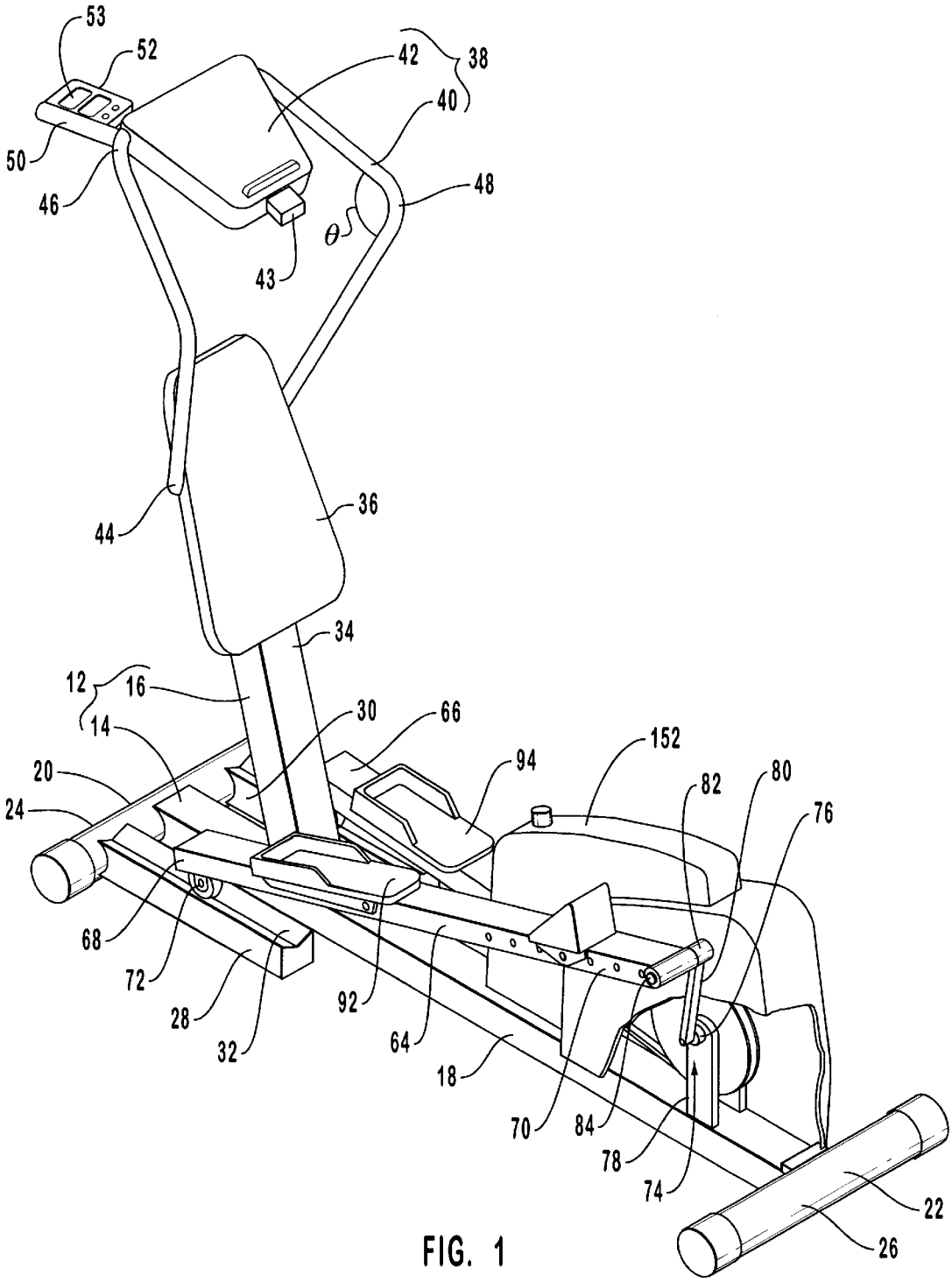
FIG. 1 is a perspective view of an inventive exercise apparatus having a support member in a first position.

Depicted in FIG. 1 is one embodiment of an inventive exercise apparatus 10 incorporating features of the present invention. Exercise apparatus 10 is configured to facilitate elliptical movement of the legs of a user. Depending on the types of muscles to be exercised, exercise apparatus 10 can be selectively positioned to permit the user to exercise in a standing position or a seated position.

Exercise apparatus 10 includes a frame 12 comprised of a base 14 having a brace 16 upstanding therefrom. Base 14 includes a central member 18 longitudinally extending from a front end 20 to an opposing back end 22. Mounted at front end 20 is a front cross member 24. Likewise, a back cross member 26 is mounted at back end 22. Projecting from front cross member 24 on opposing sides of central member 18 are tracks 28 and 30. Each track 28 and 30 projects towards back end 22 in substantially parallel alignment with central member 18. Formed on the top surface of each track 28 and 30 is an elongated groove 32.

Brace 16 is depicted as comprising an elongated shaft upwardly projecting from central member 18 to a top end 34. Mounted at top end 34 is a cushioned back rest 36. Also mounted at top end 34 of brace 16 is a support member 38. Support member 38 includes a tubular rail 40 having a substantially flat seat 42 mounted thereon. Rail 40 has an elongated somewhat circular configuration that extends from a first end 44 to an opposing second end 46. Rail 40 also has a middle portion 48 which is bent thereat at an angle $\theta$ ranging between about 60° to about 120°. In one embodiment, seat 42 is rigidly connected to second end 46 of rail 40. Projecting from seat 42 is a bumper 43.

First end 44 of rail 40 is hingedly attached to brace 16 such that support member 38 can be selectively moved between a first position and a second position. Depicted in FIG. 1, support member 38 is raise into the first position such that rail 40 functions as a hand rail support while user is standing in operation of exercise apparatus 10. Depicted in FIGS. 2 and 3, support member 38 is rotated down into the second position. In the second position, bumper 43 is biased against brace 16 such that seat 42 is orientated in a substantially horizontal position. In this configuration, a user can sit on seat 42 and rest against back rest 36 during operation of exercise apparatus 10.

Figure 2:
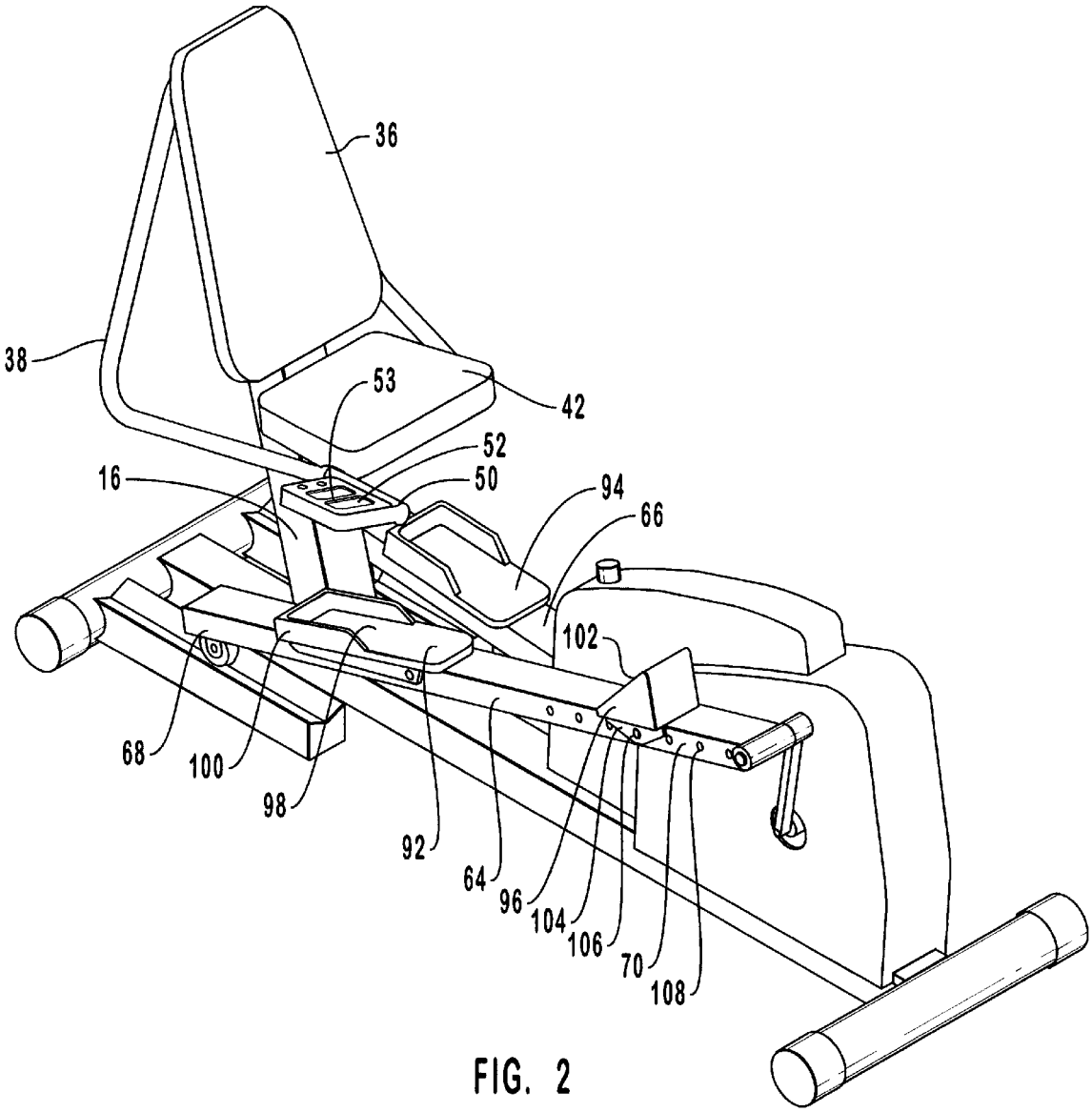
FIG. 2 is a perspective view of the inventive exercise apparatus shown in FIG. 1 with the support member in a second position.

Projecting from second end 46 of rail 40 is a rotatable shaft 50. Mounted to shaft 50 is a display console 52 having a front face 53. Shaft 50 is rotatably mounted to rail 40 so that display console 52 can be rotated at least 180°. For example, as depicted in FIG. 1, display console 52 is positioned in a first orientation such that an individual standing during the operation of exercise 10 can view front face 53. As depicted in FIG. 2, when support member 38 is moved into the second position, shaft 50 is selectively rotated 180° so that front face 53 of display console 52 can be viewed by the individual seated on seat 42.

Figure 4:
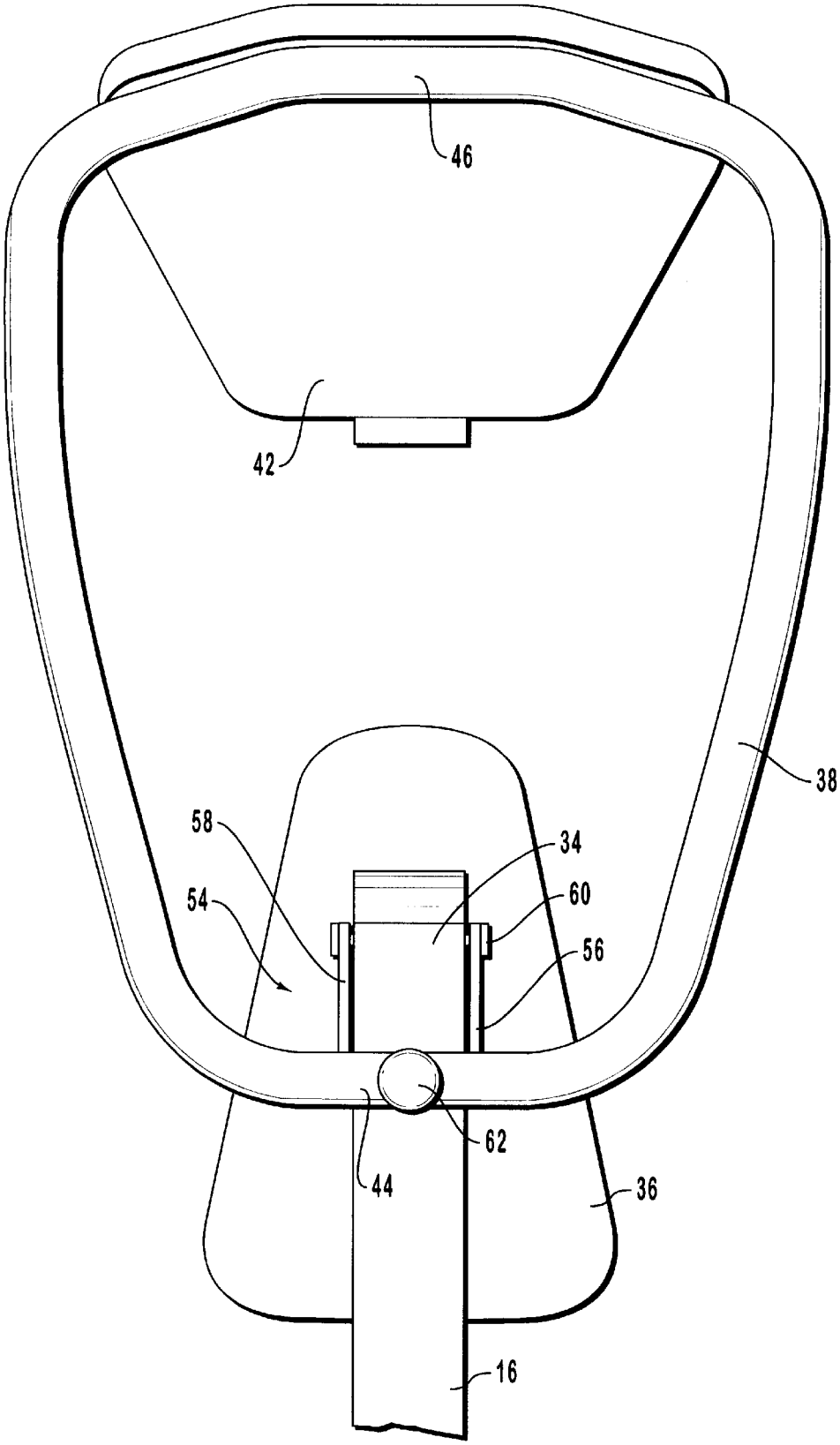
FIG. 4 is a back view of the support member shown in FIG. 4.

Depicted in FIG. 4, support member 38 is secured to brace 16 by a hinge assembly 54. Hinge assembly 54 includes a pair of rigid arms 56 and 58 which project from support member 38. Arms 56 and 58 are rotatably coupled to brace 16 by a pin 60. Support member 38 is secured in the first position by screwing a threaded bolt 62 mounted at first end 44 of support member 38 into an aperture in brace 16.

Figure 5:
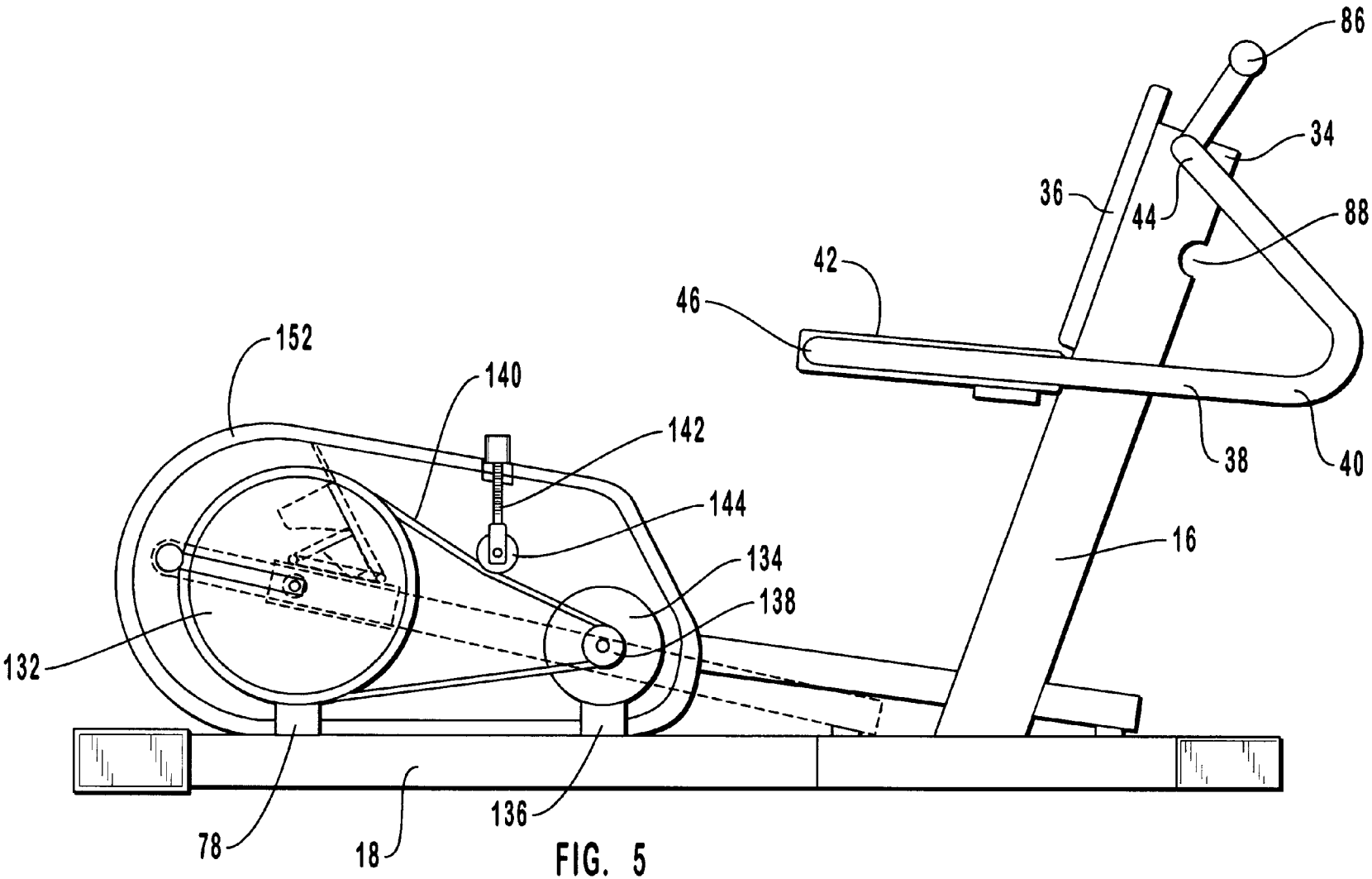
FIG. 5 is a partially cut away side view of an alternative embodiment of the exercise apparatus shown in FIG. 1.

In an alternative embodiment, as depicted in FIG. 5, second end 44 of rail 40 can be directly rotatably connected to top end 34 of brace 16. In this embodiment, a substantially U-shaped stop 86 projects from second end 44 of rail 40 so as to span across brace 16. A complementary groove 88 is formed lower down on brace 16 and is configured to receive stop 86. During use, seat 42 or an associated bumper rests against brace 16 when support member is in the second position. In the first position, first end 46 of rail 40 is rotated upward until stop 86 is received within groove 88.

Returning back to FIG. 1, exercise apparatus 10 also includes a pair of elongated foot rails 64 and 66 positioned on opposing sides of central member 18. Each foot rail 64 and 66 includes a first end 68 and an opposing second end 70. Mounted at first end 68 of each foot rail 64 and 66 is a rotatable wheel 72. Wheel 72 is disposed within grove 32 of a corresponding track 28 and 30. As a result of wheel 72 rolling back and forth within grove 32, first end 62 of each foot rail 64 and 66 is moved in a linear reciprocating displacement.

In one embodiment of the present invention, means are provided for connecting each foot rail 64 and 66 to frame 12 such that linear reciprocating displacement of first end 68 of each foot rail 64 and 66 results in displacement of a point along each foot rail 64 and 66 in a substantially elliptical path. By way of example and not by limitation, depicted in FIG. 1, a crank assembly 74 is rotatably mounted to frame 12. Crank assembly 74 comprises an axial 76 that transversely extends through a bracket 78 mounted on central member 18. Axial 76 is rotatably mounted on bracket 78 so that opposing ends of 76 are exposed on opposing sides thereof. A crank arm 80 orthogonally projects from each opposing end of axial 76. Crank arms 80 project in opposing directions such as a crank on a bicycle. Each crank arm 80 extends to a distal end 82 that is rotatably connected to second end 70 of a corresponding foot rail 64 and 66 by a bolt 84.

As a result of crank arms 80 projecting in opposing directions, foot rails 64 and 66 move in inverse reciprocating paths. That is, when second end 70 of foot rail 64 is in a raised position, second end 70 of foot rail 66 is in an opposing lower position. Furthermore, as discussed below in greater detail, as a result of first end 68 of each foot rail 64 and 66 moving in a linear path while second end 70 moves in a circular path resulting from crank assembly 74, points along foot rails 64 and 66 move in an elliptical path. Furthermore, in alternative embodiments, crank assembly 74 can connect at any point along foot rails 64 and 66.

In one embodiment of the present invention, mounted on each of the foot rails 64 and 66 are means for receiving a corresponding foot of a user when the user is in a seated position and when the user is in a standing position. By way of example and not by limitation, depicted in FIG. 2, a first pair of foot pads 92 and 94 are mounted towards first end 68 of corresponding foot rails 64 and 66. The first pair of foot pads 92 and 94 are configured to receive the feet of the user when the user is standing on foot rails 64 and 66 facing back rest 36. In the embodiment depicted, each foot pad 92 and 94 comprises a substantially flat platform 98 having a retention lip 100 upstanding around the front perimeter thereof.

Figure 3:
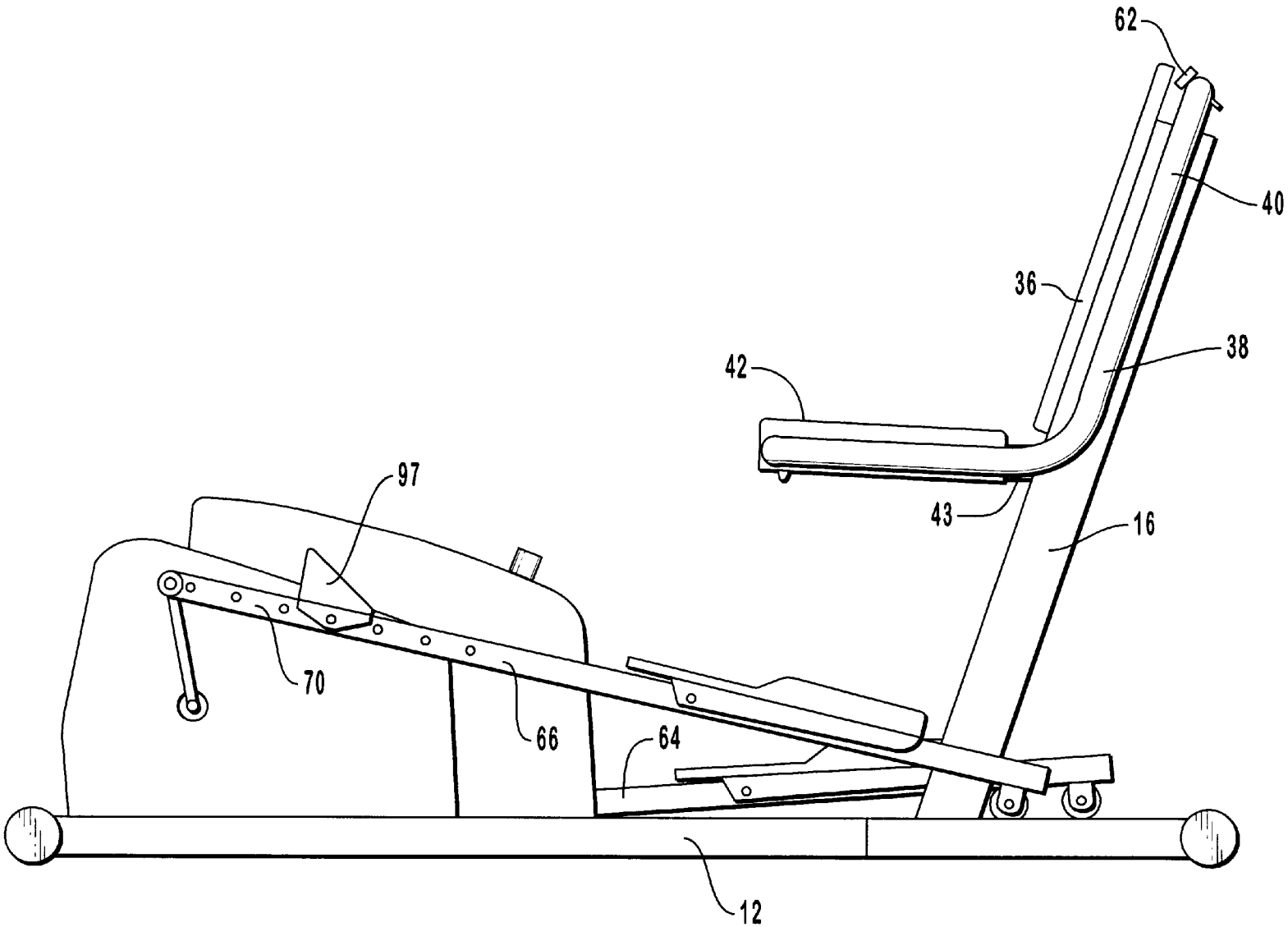
FIG. 3 is a side view of the exercise apparatus shown in FIG. 2.

As depicted in FIGS. 2 and 3, a second pair of foot pads 96 and 97 are mounted towards second end 70 of foot rails 64 and 66. Each foot pad 96 and 97 has a substantially triangular configuration with a sloping front face 102. Foot pads 96 and 97 are configured to receive the feet of the user on front face 102 when the user is seated on seat 42.

Means are also provided for selectively positioning foot pads 96 and 97 along the length of foot rails 64 and 66. By way of example, a bracket 104 projects down from at least one each side of each foot pad 96 and 97 so as to be disposed on the side of each foot rail 64 and 66. An aperture 106 extends through each bracket 104. A plurality of spaced apart passageways 108 transversely extend through each of foot rail 64 and 66. Accordingly, by aligning apertures 106 with a corresponding passageway 108, a pin can be passed therethrough so as to secure each foot pad 96 and 97 at a desired position along foot rails 64 and 66. In an alternative embodiment, a retractable spring actuated pin can be mounted on each foot pad 96 and 97 to removably pass through aperture 106 and into passageway 108. Conventional clamping structures can also be used to selectively position foot pads 96 an 97. Similar means can also be used to selectively position foot pads 92 and 94 along foot rails 64 and 66.

Figure 6:
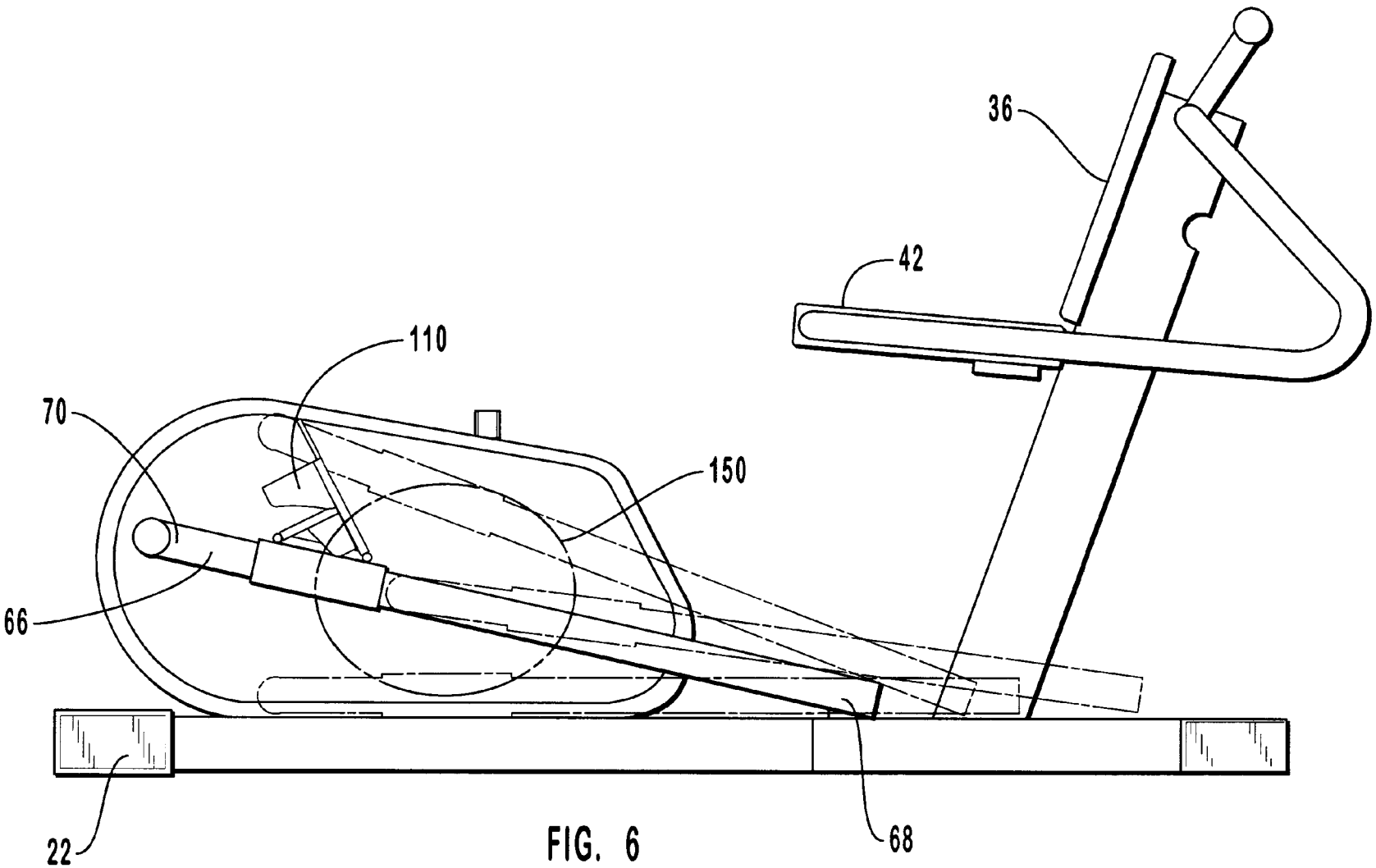
FIG. 6 is a side view of the exercise apparatus shown in FIG. 5 depicting the travel path of the foot rails.
Figure 7A:
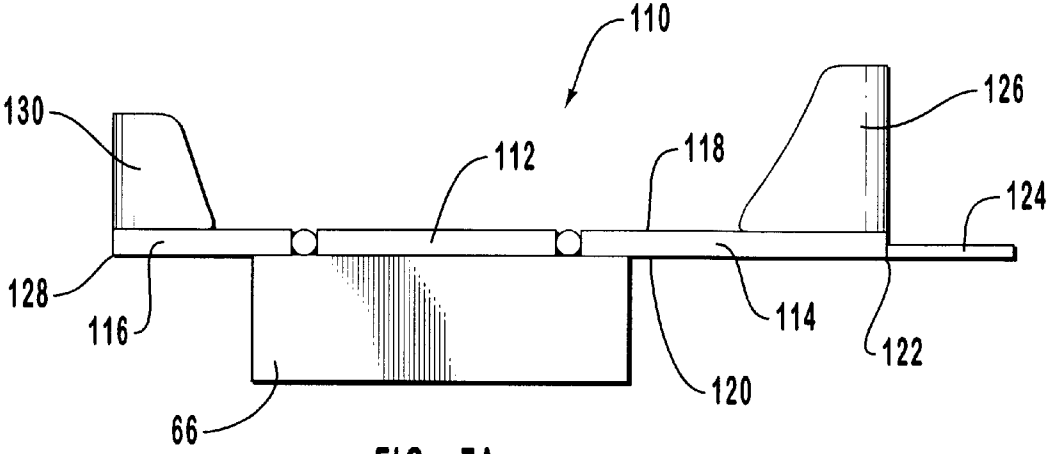
FIG. 7A is a side view of a collapsible foot pad shown in FIG. 6 in a first position.

Depicted in FIG. 6 is an alternative embodiment of the means for receiving a corresponding foot of a user when the user is in a seated position and when the user is in a standing position. Depicted therein, a collapsible foot pad 110 is mounted on each foot rail 64 and 66. As depicted in FIG. 7A, each collapsible foot pad 110 comprises a center plate 112 that can be adjustably positioned along the length of a corresponding foot rail 64 and 66. A front plate 114 is hingedly mounted to the front end of center plate 112 while a back plate 116 is hingedly mounted to the back end of center plate 112. Front plate 114 includes a top surface 118 and an opposing back surface 120 which both extend to a free end 122. Projecting out from free end 122 is a support tab 124. Upwardly projecting around the perimeter of free end 122 is a retention lip 126. Back plate 116 also projects to a remote free end 128 and has a retention lip 130 upwardly projecting around the perimeter thereof.

Figure 7B:
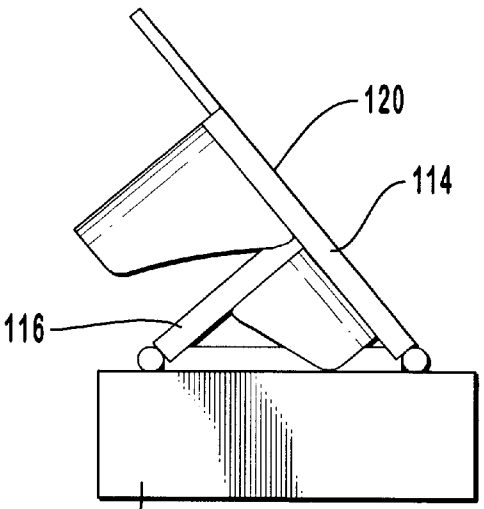
FIG. 7B is a side view of the collapsible foot pad shown in FIG. 7A in a first position.

Each collapsible foot pad 110 can be moved between first and second positions. In the first position, as depicted in FIG. 7A, front plate 114 and back plate 116 are horizontally disposed in alignment with center plate 112. In this position, the foot of a user rests on top of plates 112, 114, and 116 so as to operate exercise apparatus 10 while in a standing position. In the second position, as depicted in FIGS. 6 and 7B, back plate 116 is folded forward and front plate 114 is folded backwards so as to lock over back plate 116. In this position, back surface 120 of front plate 114 slopes backward towards back end 22 of exercise apparatus 10. The user can thus rest his or her foot against back surface 120 of corresponding collapsible foot pads 110 so as to operate exercise 10 when seated upon seat 42.

During operation, the user selectively adjusts exercise apparatus 10 for operation in either a standing or sitting position. The different positions exercise different sets of muscles. For exercising in the standing position, support member 38 is moved into the first position, as depicted in FIG. 1, and the user stands on foot pads 92 and 94 facing back rest 36. If desired, the user can rest his or her arms on rail 40. In this position, the user uses his or her leg muscles to move foot rails 64 and 66 in inverse reciprocating movement. Specifically, as depicted in FIG. 6, as a result of first end 68 of foot rails 64 and 66 moving in linear reciprocating movement and second end 70 of foot rails 64 and 66 moving in circular movement, foot pads 92 and 94 disposed between ends 68 and 70 move in a substantially elliptical path as depicted by dashed line 150 in FIG. 6.

For exercising in the sitting position, support member 38 is moved into the second position, as shown in FIGS. 2 and 3. The user then sits on seat 42 with his or her back against back rest 36 and feet against front face 102 of corresponding foot pads 96 and 97. By pushing against foot pads 96 and 97, foot pads 96 and 97 are also moved in a substantially elliptical path as depicted by dashed line 150 in FIG. 6. The actual travel path of elliptical path 150 changes depending on which foot pads are used and the position of the foot pads.

In one embodiment of the present invention, means are also provided for conserving momentum generated by rotation of crank assembly 74. By way of example and not by limitation, as depicted in FIG. 5, mounted to axle 76 is an enlarged annular fly wheel 132. A weighted wheel 134 is rotatably attached to center member 18 by a bracket 136. Attached to one side of weighted wheel 134 in axial alignment therewith is a drive wheel 138. A belt 140 loops between fly wheel 132 and drive wheel 138. A tension arm 142 having a wheel 144 attached to the end thereof is biased against belt 140 so as to keep belt 140 properly tensioned. In alternative embodiments, tension arm 142 can be spring biased against belt 140. Accordingly, as axial 176 is rotated, fly wheel 132 is simultaneously rotated. The movement of fly wheel 132 is transferred through belt 140 to drive wheel 138. In turn, weighted wheel 134 is rotated. As a result of the increased weight of wheel 134, once wheel 134 begins to rotate, the force produced therein is transferred back into fly wheel 132 to maintain even continued reciprocating displacement of foot rails 64 and 66. The means for conserving momentum is disposed within a housing 152.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An exercise apparatus comprising:

(a) a frame including an upstanding member;

(b) a pair of spaced apart foot rails each having a first end and an opposing second end, each foot rail being configured to receive a corresponding foot of a user;

(c) a support member mounted to the upstanding member of the frame and movable between a first position wherein the support member is configured to support a user in a seated position and a second position wherein the support member is configured to operate as a hand rail when a user is in a standing position; and (d) means for connecting each foot rail to the frame such that linear reciprocating displacement of the first end of each foot rail results in displacement of a point along the foot rail in a substantially elliptical path.

2. An exercise apparatus as recited in claim 1, wherein the support member comprises:

(a) a rail having a first end rotatably mounted to the upstanding member of the frame and an opposing second;

(b) a seat mounted at the second end of the rail.

3. An exercise apparatus as recited in claim 1, further comprising a control panel rotatably mounted on the support member.

4. An exercise apparatus as recited in claim 1, further comprising means mounted on each of the foot rails for receiving a corresponding foot of a user when the user is in a seated position and when the user is in a standing position.

5. An exercise apparatus as recited in claim 4, wherein the means for receiving a corresponding foot comprises:

(a) a first foot pad positioned at the first end of each foot rail; and (b) a second foot pad positioned at the second end of each foot rail.

6. An exercise apparatus as recited in claim 1, wherein the means for connecting comprises:

(i) an axil having opposing ends, the axil being rotatably mounted to the frame; and (ii) a crank arm having a first end rigidly mounted on each opposing end of the axil and an opposing second end rotatably mounted to the second end of a corresponding foot rail.

7. An exercise apparatus as recited in claim 6, further comprising means for conserving momentum generated by rotation of the axil.

8. An exercise apparatus as recited in claim 1, wherein each foot rail is substantially linear.

9. An exercise apparatus comprising:

(a) a frame having a seat mounted thereon;

(b) a pair of spaced apart foot rails each having a first end and an opposing second end;

(c) a foot pad mounted on each foot rail, each foot pad being configured to receive a corresponding foot of a user when the user is seated on the seat; and (d) means for connecting each foot rail to the frame such that linear reciprocating displacement of the first end of each foot rail results in displacement of a point along the foot rail in a substantially elliptical path; and (e) a support member mounted to the frame and movable between a first position wherein the support member is configured to support a user in a seated position and a second position wherein the support member is configured to operate as a hand rail when a user is in a standing position.

10. An exercise apparatus as recited in claim 9, wherein the means for connecting comprises:

(i) an axil having opposing ends, the axil being rotatably mounted to the frame; and (ii) a crank arm having a first end rigidly mounted on each opposing end of the axil and an opposing second end rotatably mounted to the second end of a corresponding foot rail.

11. An exercise apparatus as recited in claim 10, further comprising means for conserving momentum generated by rotation of the axil.

12. An exercise apparatus as recited in claim 9, wherein each foot rail is substantially linear.

13. An exercise apparatus as recited in claim 9, wherein each foot pad has a substantially triangular configuration.

14. An exercise apparatus comprising:

(a) a frame configured to rest on a ground surface;

(b) a pair of spaced apart foot rails each having a first end and an opposing second end;

(c) a rotatable crank assembly connecting each of the foot rails to the frame; and (d) means mounted to each of the foot rails for receiving a corresponding foot of a user when the user is in a seated position and when the user is in a standing position, and (e) a support member mounted to the frame and movable between a first position wherein the support member is configured to support a user in a seated position and a second position wherein the support member is configured to operate as a hand rail when a user is in a standing position.

15. An exercise apparatus as recited in claim 14, wherein the means for receiving a corresponding foot comprises:

(a) a first foot pad positioned at the first end of each foot rail; and (b) a second foot pad positioned at the second end of each foot rail.

16. An exercise apparatus as recited in claim 15, further comprising means for selectively positioning the second foot pad along the length of the corresponding foot rail.

17. An exercise apparatus as recited in claim 14, wherein the means for receiving a corresponding foot comprises a collapsible foot pad mounted to each foot rail, each collapsible foot pad comprising:

(a) a center plate mounted to the corresponding foot rail and having a front end and an opposing back end;

(b) a front plate hingedly mounted to the front end of the center plate; and (c) a back plate hingedly mounted to the back end of the center plate, the front and back plate being configured to fold together into a supported substantially triangular configuration.

18. An exercise apparatus as recited in claim 14, wherein the frame includes an upstanding member and the support member comprises:

(a) a rail having a first end rotatably mounted to the upstanding member of the frame and an opposing second; and (b) a seat mounted at the second end of the rail.

19. An exercise apparatus as recited in claim 14, further comprising a control panel rotatably mounted on the support member.

20. An exercise apparatus comprising:

(a) a frame including an upstanding member;

(b) a support member mounted to the upstanding member of the frame and movable between a first position wherein the support member is configured to support a user in a seated position and a second position wherein the support member is configured to operate as a hand rail when a user is in a standing position;

(c) a pair of spaced apart foot rails each having a first end and an opposing second end;

(d) a rotatable crank assembly connecting each of the foot rails to the frame;

(e) a first pair of foot pads mounted on the foot rails, the first pair of foot pads being configured to receive the feet of the user when the user is in the standing position; and (f) a second pair of foot pads mounted on the foot rails, the second pair of foot pads being configured to receive the feet of the user when the user is seated.

21. An exercise apparatus as recited in claim 20, wherein the second pair of foot pads have a substantially triangular configuration.

22. An exercise apparatus as recited in claim 20, further comprising means for conserving momentum generated by rotation of the crank assembly.

23. An exercise apparatus as recited in claim 22, wherein the means for conserving momentum comprises:

(a) a flywheel mounted to the crank assembly;

(b) a weighted wheel rotatably mounted to the frame; and (c) a belt extending from the flywheel to the weighted wheel.

24. An exercise apparatus as recited in claim 20, further comprising a track mounted to the frame and a wheel mounted to the first end of one of the foot rails, the wheel being engaged with the track to enable linear reciprocating displacement of the wheel along the track.

* * * * *

UNITED STATES PATENT AND TRADEMARK OFFICE

CERTIFICATE OF CORRECTION

PATENT NO. : 6,171,217 B1
DATED : January 9, 2001
INVENTOR(S) : Gordon L. Cutler It is certified that error appears in the above-identified patent and that said Letters Patent is hereby corrected as shown below:

Column 1,
Line 12, before "to exercise" change "develop" to -- developed --
Line 24, after "to slide" change "their" to -- his or her --

Column 2,
Line 20, after "which" change "permit" to -- permits --

Column 3,
Line 36, before "towards" change "Each track 28 and 30 projects" to -- Both tracks 28 and 30 project --
Line 38, after "surface of" change "each" to -- both --
Line 56, after "38 is" change "raise" to -- raised --

Column 4,
Line 23, after "16 when" change "support member" to -- the support member --

Column 5,
Line 18, after "64 and" change "66" to -- 66, respectivly --
Line 21, after "64 and" change "66" to -- 66, respectivly --
Line 23, after "transversely" change "extend" to -- extends --
Line 27, after "64 and" change "66" to -- 66, respectivly --
Line 34, after "64 and" change "66" to -- 66, respectivly --

UNITED STATES PATENT AND TRADEMARK OFFICE

CERTIFICATE OF CORRECTION

PATENT NO. : 6,171,217 B1
DATED : January 9, 2001
INVENTOR(S) : Gordon L. Cutler It is certified that error appears in the above-identified patent and that said Letters Patent is hereby corrected as shown below:

Column 7,
Line 7, after "second" insert -- end --
Line 24, change "(i)" to -- (a) --
Line 26, change "(ii)" to -- (b) --
Line 55, change "(i)" to -- (a) --
Line 57, change "(ii)" to -- (b) --

Signed and Sealed this

Twenty-third Day of April, 2002

*Attest:*

*Attesting Officer*

JAMES E. ROGAN
*Director of the United States Patent and Trademark Office*